US006857848B2

(12) United States Patent
Fokine et al.

(10) Patent No.: US 6,857,848 B2
(45) Date of Patent: Feb. 22, 2005

(54) GAP SEAL IN A GAS TURBINE

(75) Inventors: Arkadi Fokine, Moscow (RU); Igor Ossipov, Moscow (RU); Dmitry Petrunin, Moscow (RU); Joerg Stengele, Ruetihof (CH); Alexander Trishkin, Lytkarino (RU)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 10/372,331

(22) Filed: Feb. 25, 2003

(65) Prior Publication Data

US 2003/0165381 A1 Sep. 4, 2003

(30) Foreign Application Priority Data

Mar. 1, 2002 (DE) ..... 102 09 295

(51) Int. Cl.[7] ..... F01O 11/08

(52) U.S. Cl. ..... 415/116; 415/136; 415/138; 415/139; 415/173.1; 415/173.3; 415/178

(58) Field of Search ..... 415/134, 135, 415/136, 138, 139, 115, 116, 173.1, 173.3, 174.2, 175–178

(56) References Cited

U.S. PATENT DOCUMENTS 4,213,296 A * 7/1980 Schwarz ..... 415/116
4,379,560 A * 4/1983 Bakken ..... 415/135
4,425,078 A 1/1984 Robbins
4,573,866 A * 3/1986 Sandy, Jr. et al. ..... 415/116
5,975,844 A 11/1999 Milazar et al.

FOREIGN PATENT DOCUMENTS

| | | | |
|---|---|---|---|
| DD | 2855157 | C2 | 6/1979 |
| DD | 3126359 | A1 | 7/1982 |
| DE | 199 40 556 | A1 | 3/2001 |
| EP | 0 357 984 | A1 | 3/1990 |
| GB | 1 358 798 | | 7/1974 |
| GB | 1534660 | A * | 12/1978 |

OTHER PUBLICATIONS

Great Britain Search Report dated Aug. 12, 2003.

* cited by examiner

*Primary Examiner*—Christopher Verdier
(74) *Attorney, Agent, or Firm*—Burns, Doane, Swecker & Mathis, L.L.P.

(57) ABSTRACT

A gap seal in a gas turbine for sealing off a cooling space, formed between a heat shield and a heat shield carrier, from a hot gas space of the gas turbine. A sealing body is retained in a movable manner on the heat shield, on the one hand, and on a blade carrier, on the other hand, adjacent to the heat shield carrier.

2 Claims, 1 Drawing Sheet

GAP SEAL IN A GAS TURBINE

FIELD OF THE INVENTION

The invention relates to a gap seal in a gas turbine for sealing off a cooling space, formed between a heat shield and a heat shield carrier, from a hot gas space of the gas turbine.

BACKGROUND OF THE INVENTION

In a gas turbine, in each case a heat shield is arranged axially between two adjacent guide blades, this heat shield being fastened via a heat shield carrier to a stator or to the casing of the gas turbine. A corresponding construction also results for a rotor of the gas turbine, in which construction a heat shield may likewise be arranged between two adjacent rotor blades, this heat shield being fastened to the rotor by means of a heat shield carrier. The guide blades of the stator and the rotor blades of the rotor normally have a root which is designed as a blade carrier and with which the respective blade is anchored in the stator or the rotor. In this case, the blades of the gas turbine are arranged in a hot gas space of the gas turbine, hot gases flowing through this hot gas space during operation of the gas turbine. To cool the heat shield, a cooling space, to which a cooling gas is admitted or through which a cooling gas flows during operation of the gas turbine, is formed between the heat shield carrier and heat shield. A gap which is open toward the hot gas space and thus communicates with the latter is normally formed axially between a heat shield carrier and an adjacent blade carrier. In order to now prevent a gas exchange between the cooling space and the hot gas space, gap seals of the type mentioned at the beginning are used. For this purpose, a sealing body of the gap seal can be retained on the heat shield, on the one hand, and on the heat shield carrier, on the other hand, as a result of which effective sealing of the cooling space relative to the gap and thus relative to the hot gas space can be achieved.

SUMMARY OF THE INVENTION

The invention, as characterized in the claims, deals with the problem of specifying an improved embodiment for a gap seal of the type mentioned at the beginning, this improved embodiment permitting in particular improved cooling.

According to the invention, this problem is solved by the subject matter of the independent claim. Advantageous embodiments are the subject matter of the dependent claims.

The invention is based on the general idea of retaining the sealing body, on its side facing away from the heat shield, not on the heat shield carrier but on the adjacent blade carrier. By this type of construction, the gap between blade carrier and heat shield carrier is subdivided into a section communicating with the hot gas space and a section separated therefrom by the sealing body. Since no hot gases can enter from the hot gas space in that section of the gap which is separated from the hot gas space, the blade carrier and the heat shield carrier in this gap section are only subjected to reduced thermal loading. Accordingly, the cooling requirement decreases, or an improved cooling effect can be achieved with the same cooling capacity. In addition, the heat shield is normally not attached to the heat shield carrier in a gas-tight manner, so that cooling gas can penetrate into the gap from the cooling space. This leakage results in an additional cooling effect for the blade carrier and the heat shield carrier.

According to a preferred embodiment, the heat shield and the heat shield carrier may have at least one passage which connects the cooling space in a communicating manner with a gap, formed axially between heat shield carrier and blade carrier, at a location sealed off from the hot gas space by the sealing body. In this way, the gap section separated from the hot gas space can be specifically supplied with cooling gas, as a result of which the cooling of blade carrier and heat shield carrier is improved.

According to an especially advantageous embodiment, the gap, in a section which is sealed off from the hot gas space by the sealing body, can form a flow path for the cooling gas recirculation. By this type of construction, the gap may be used for the cooling gas recirculation, as a result of which direct and specific admission of cooling gas to the blade carrier and the heat shield carrier in the gap is possible. Since, in this type of construction, the cooling gas recirculation is not effected or is no longer effected completely inside the heat shield carrier, larger cross sections through which flow can occur are available in the heat shield carrier, so that the cooling capacity overall can be increased by a correspondingly increased volumetric flow of cooling gas. The cooling of the blade carrier which can be achieved is of particular interest for a long service life of the respective blade.

According to another important embodiment, the blade carrier may have a collar which projects axially toward the heat shield carrier and in which a locating groove is formed which is open toward the heat shield and into which the sealing body, with its side assigned to the blade carrier, is inserted. By this type of construction, it is possible in an especially simple manner to arrange the locating groove of the blade carrier radially opposite a locating groove which is formed on the heat shield, is open toward the heat shield carrier and into which the sealing body, with its side assigned to the heat shield, is inserted. As a result, an essentially radial orientation is obtained for the sealing body inserted into the locating grooves, so that pressure differences between the cooling space and the hot gas space act merely as axial pressure forces on the sealing body, so that, accordingly, it is also only axial forces which are transmitted from the sealing body to the blade carrier and the heat shield and thus to the heat shield carrier. As a result, additional radial loading of the sealing body, of the blade carrier, of the heat shield and of the heat shield carrier can be avoided or at least reduced.

In a development, the heat shield carrier may have an axial recess into which the collar projects. In this way, the radial arrangement of the two locating grooves of blade carrier and heat shield is simplified.

Further important features and advantages of the gap seal according to the invention follow from the subclaims, the drawing and the associated description of the figures with reference to the drawing.

BRIEF DESCRIPTION OF THE DRAWINGS

A preferred exemplary embodiment is shown in the drawing and will be explained in more detail in the description below. The single

DETAILED DESCRIPTION OF THE INVENTION

Figure 1:
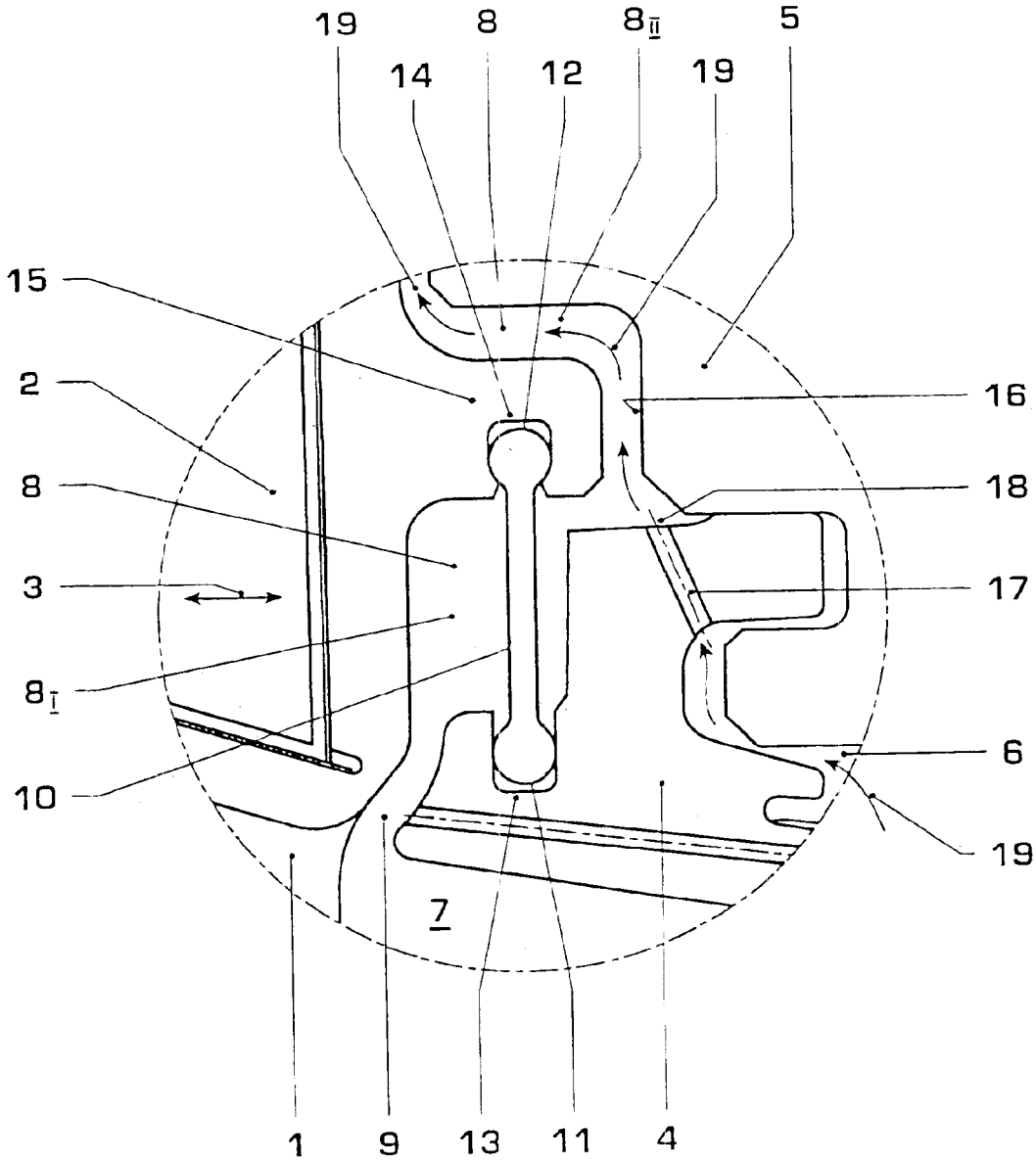
FIG. 1 shows a longitudinal section through a gas turbine in the region of a gap seal according to the invention.

According to FIG. 1, in a gas turbine, here shown only as a detail, a blade 1 together with its blade carrier 2 is anchored on a stator (not shown here) of the turbine, so that the blade 1 is a guide blade 1. Although the invention, in the present case, is explained with reference to a guide blade 1, it is clear that the invention can in principle also be applied in the case of a rotor blade, in which the blade carrier 2 is anchored in a corresponding manner on a rotor of the gas turbine.

The blade 1 or its blade carrier 2, in the axial direction, which is symbolized by a double arrow in FIG. 1 and is designated by 3, adjoins a heat shield 4 and a heat shield carrier 5. This axial direction 3 runs parallel to the rotation axis of the rotor of the gas turbine. The heat shield 4 is fastened to the heat shield carrier 5, which in turn is anchored in the stator or in the rotor of the gas turbine.

Formed between the heat shield carrier 5 and the heat shield 4 is a cooling space 6, to which, at a location not shown here, cooling gas is admitted in a conventional manner. The heat shield 4 is exposed to a hot gas space 7 of the gas turbine, the blade 1 projecting into this hot gas space 7. A gap 8 is formed in the axial direction between the blade carrier 2 and the heat shield carrier 5 with heat shield 4 attached thereto and communicates with the hot gas space 7 at 9 in the region of the heat shield 4.

In order to prevent a gas exchange between the cooling space 6 and the hot gas space 7, e.g. on account of leakage, a sealing body 10 is provided. According to the invention, this sealing body 10 is retained in a movable manner on the heat shield 4, on the one hand, with a first side 11 and on the blade carrier 2, on the other hand, with a second side 12. The sealing body 10, due to its arrangement according to the invention, passes through the gap 8 and in the process divides the gap 8 into a first section 8I communicating with the hot gas space 7 and a second section 8II sealed off from the hot gas space 7. The sealing body 10 may be designed as a ring or an annular segment, which in the present case has an elongated cross section. The sides 11 and 12 of the sealing body 10 are designed to be thicker relative to a section lying between the two sides 11 and 12 and have an essentially circular cross section.

To retain the sealing body 10, the heat shield 4 has a first locating groove 13, into which the first side 11 of the sealing body 10 projects. The first locating groove 13 has an essentially U-shaped cross section and is open toward the heat shield carrier 5. In the preferred embodiment shown, the first locating groove 13, with respect to its open side, is radially oriented. In a corresponding manner, for the retention of the sealing body 10, a second locating groove 14, into which the second side 12 of the sealing body 10 projects, is formed on the blade carrier 2. The second locating groove 14 likewise has an essentially U-shaped cross section and is open toward the heat shield 4. The second locating groove 14 is also expediently radially oriented with respect to its open side.

According to the special embodiment shown here of the present invention, the blade carrier 2 has a collar 15 in which the second locating groove 14 is formed. This collar 15 projects from the blade carrier 2 in the axial direction 3 toward the beat shield carrier 5. This collar 15 is expediently integrated in the blade carrier 2, so that the collar 15 is formed integrally or in one piece on the blade carrier 2. In a complementary manner to the collar 14, the heat shield carrier 5 has an axial recess 16, which in this case is designed as a shoulder or step. The collar 15 of the blade carrier 2 projects axially into this recess 16.

By means of the collar 15, it is possible in an especially simple manner to arrange the two locating grooves 13 and 14 relative to one another in such a way that they are essentially radially opposite one another. Consequently, the sealing body 10 inserted into the locating grooves 13, 14 has an essentially radial orientation. The sealing body 10, due to its arrangement, can only transmit axial forces to the blade carrier 2 and the heat shield 4, which may occur on account of pressure differences between cooling space 6 and hot gas space 7.

The locating grooves 13, 14 and the sides 11, 12 of the sealing body 10 are matched to one another in such a way that the sealing body 10 is arranged in the locating grooves 13, 14 with radial play and so as to be pivotable. As a result, the sealing body 10 can follow relative movements between heat shield 4 and blade carrier 2 and maintain the desired sealing effect in the process.

In the special embodiment shown here, the heat shield 4 contains a passage 17. It is clear that, in principle, a plurality of such passages 17 may also be provided. The passage 17 connects the cooling space 6 to the gap section 8II separated from the hot gas space 7. For this purpose, the passage 17 opens into the gap 8 at a location which is sealed off from the hot gas space 7 by the sealing body 10 and is designated by 18. It is clear that, additionally or alternatively, such a passage 17 or a plurality of such passages 17 may also be formed in the heat shield carrier 5.

It is especially expedient to use the gap section 8II separated from the hot gas space 7 for the cooling gas recirculation. A cooling gas flow is indicated in FIG. 1 by means of arrows, as a result of which it can be seen that the gap section 8II sealed off from the hot gas space 7 forms a flow path for the cooling gas, and this flow path can be expediently used for the cooling gas recirculation. In this case, the cooling gas recirculation is represented by the arrows of the cooling gas flow and is designated by 19. If the gap 8 or its gap section 8II separated from the hot gas space 7 is used according to the invention for the cooling gas recirculation 19, the blade carrier 2 and the heat shield carrier 5 can be additionally cooled. At the same time, more cooling gas can be fed to the cooling space 6 through the heat shield carrier 5, as a result of which the cooling capacity overall can be increased.

LIST OF DESIGNATIONS

1 Blade
2 Blade carrier
3 Axial direction
4 Heat shield
5 Heat shield carrier
6 Cooling space
7 Hot gas space
8 Gap
8I Gap section communicating with 7
8II Gap section separated from 7
9 Connection between 7 and 8
10 Sealing body
11 First side of 10
12 Second side of 10
13 First locating groove
14 Second locating groove
15 Collar
16 Recess
17 Passage
18 Location
19 Cooling gas recirculation

What is claimed is:

1. A gap seal in claim 1 in a gas turbine for sealing off a cooling space formed between a heat shield and a heat shield carrier, from a hot gas space of the gas turbine, comprising: a sealing body which is retained in a movable manner between the heat shield and a blade carrier, wherein a gap formed axially between the heat shield carrier and the blade carrier, in a section which is sealed off from the hot gas space by the sealing body, forms a flow path for the cooling gas recirculation.

2. A gap seal in a gas turbine for sealing off a cooling space formed between a heat shield and a heat shield carrier, from a hot gas space of the gas turbine, comprising: a sealing body which is retained in a movable manner between the heat shield and a blade carrier, wherein the heat shield has first and second grooves which are open toward the heat shield carrier and into which the sealing body with its side assigned to the heat shield, is inserter, the blade carrier having a collar which projects axially toward the heat shield carrier and in which a locating groove of the blade carrier is formed, and wherein the heat shield carrier has an axial recess into which the collar projects.

* * * * *